United States Patent [19]

Block

[11] Patent Number: 4,586,413

[45] Date of Patent: May 6, 1986

[54] SIGN MAKING MACHINE

[75] Inventor: Harvey P. Block, Westport, Conn.

[73] Assignee: U.S. Highway Products, Inc., Orangeburg, N.Y.

[21] Appl. No.: 698,605

[22] Filed: Feb. 6, 1985

Related U.S. Application Data

[63] Continuation-in-part of Ser. No. 651,607, Sep. 17, 1984.

[51] Int. Cl.[4] ..... B26D 7/27

[52] U.S. Cl. ..... 83/522; 83/33; 83/436; 83/684; 83/650; 101/26

[58] Field of Search ..... 83/33, 139, 228, 530, 83/650, 684, 685, 691, 436, 522, 649; 101/27, 26, 30, 28

[56] References Cited

U.S. PATENT DOCUMENTS

| | | | |
|---|---|---|---|
| 847,536 | 3/1907 | Zimmerman | 83/650 X |
| 1,082,985 | 12/1913 | Wilder et al. | 83/684 X |
| 1,467,481 | 9/1923 | Juline | 83/649 X |
| 2,342,049 | 2/1944 | Holmbeck | 83/228 |
| 2,357,557 | 9/1944 | Sherman et al. | 83/228 X |
| 3,397,826 | 8/1968 | Hawley et al. | 83/650 X |
| 3,656,392 | 4/1972 | Krynytzky et al. | 83/530 |

*Primary Examiner*—Clifford D. Crowder

*Attorney, Agent, or Firm*—Jeffrey S. Mednick; Perry Palan

[57] ABSTRACT

A sign making machine is provided comprising a frame and a power unit attached to the frame. A hydraulic cylinder is also attached to the frame and is hydraulically connected to the power unit. This hydraulic cylinder has a piston rod extending downwardly. A platen is mounted on the bottom of said piston rod and a die is mounted beneath said platen. Sheet material is mounted on rolls and passes beneath said die on a cutting surface on the bottom portion of the frame. The sheet material passes through a track means. Indicia on the die indicate a width quotient of a symbol to be cut. A drive unit advances the sheeting material by a distance equal to the width quotient of the symbol plus the width quotient of the next symbol to be cut plus the spacing between these symbols.

11 Claims, 13 Drawing Figures

SIGN MAKING MACHINE

CROSS-REFERENCE TO RELATED APPLICATION

This application is a continuation-in-part of U.S. application Ser. No. 651,607 filed on Sept. 17, 1984 and entitled A sign Making Machine.

BACKGROUND AND SUMMARY OF INVENTION

The present invention relates to a sign making machine, and more particularly, to a sign making machine wherein the material on which the signs are to be made may be continuously fed.

Sign making machines typically cut a single letter or symbol from a piece of material. This has been accomplished by placing a die (face up) on a surface beneath a platen that may be actuated vertically downwardly by a hydraulic piston. When a piece of material is placed on the die and the piston is actuated, the symbol or letter is punched from the material. In the alternative, a piece of material was placed beneath the die (face down) which was struck by a piston actuated platen. In either case, the operator then removes the material including the symbol that has been cut. This procedure may be repeated as often as desired. When one desired to produce a difference letter or symbol, the die had to be removed and a new die inserted. Since different letters and symbols have different widths, it was very difficult to line up various letters or symbols on a single sheet with proper spacing.

It is, therefore, an object of the present invention to provide an improved sign making machine.

It is a further object of the present invention to provide a sign making machine having a continuous feed of sheet material.

It is a further object of the present invention to provide a sign making machine wherein various dies may be quickly and simply installed into the platen.

It is a further object of the present invention to provide a sign making machine that is simple and safe to operate.

It is a further object of the present invention to provide a sign making machine that will provide a plurality of letters or symbols at one time.

It is a further object of the present invention to provide a sign making machine with indicia on the dies so the operator will be able to calculate how far to advance the sheet material.

These and other objects, advantages and novel features of the present invention will become apparent from the following detailed description of the invention when considered in conjunction with the accompanying drawings which show, for purposes of illustration and example only, a preferred embodiment in accordance with the present invention.

BRIEF DESCRIPTION OF DRAWINGS

FIG. 8 is a front view of a modified sign making machine in accordance with the present invention.

DETAILED DESCRIPTION OF THE INVENTION

Figure 1:
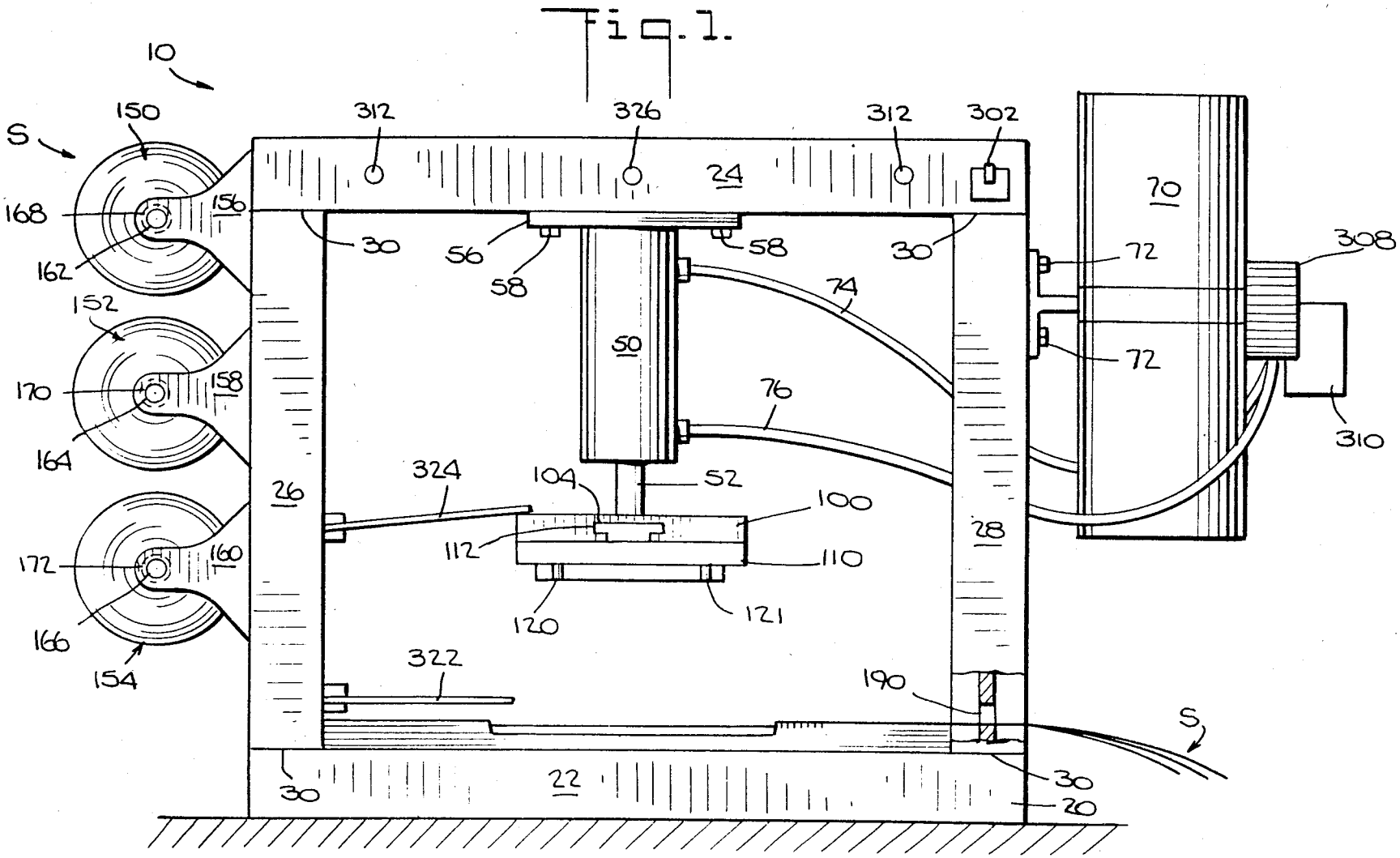
FIG. 1 is a front view of a sign making machine in accordance with the present invention.

Referring to FIG. 1, there is shown a sign making machine 10 in accordance with the present invention. As shown, sign making machine 10 includes a frame 20. As illustrated, the frame includes a lower horizontally extending member 22, an upper horizontally extending member 24, a left vertically extending member 26 and a right vertically extending member 28. These members may comprise as steel I beams, but other members may be suited as long as they provide adequate structural support for the apparatus. As shown, the members are attached to each other, such as by welds 30.

A hydraulic cylinder 50 includes a piston rod 52. The upper end of hydraulic cylinder 50 includes a mounting means, such as flange 56 so that the hydraulic cylinder 50 may be mounted to upper horizontally extending member 24. Bolts 58 extend through flange 56 and upper horizontally extending member 24 to hold hydraulic cylinder 50 in place.

A single direction power unit 70 is mounted to right vertically extending member 28 by means of bolts 72. Power unit 70 is hydraulically connected by means of hoses 74 and 76 to hydraulic cylinder 50. Power unit 70 operates to supply fluid to the cylinder as will be described herein below.

Figure 2:
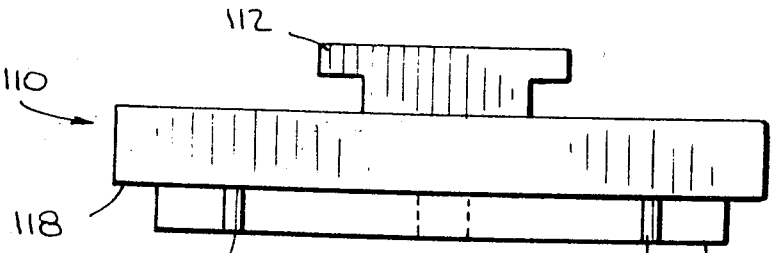
FIG. 2 is a front view of a die made in accordance with the present invention.
Figure 3:
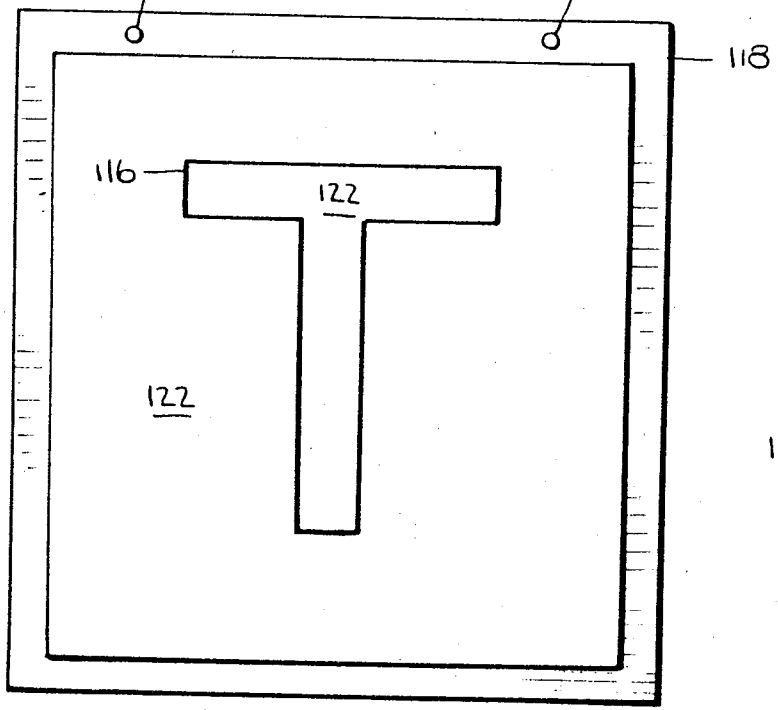
FIG. 3 is a bottom view of the die shown in FIG. 3.

A steel platen 100 includes a threaded hole (not shown) in its top surface so that the platen 100 may be mounted on a complementary male thread (also not shown) on piston rod 52. In the bottom surface of platen 100 is a T-shaped aperture. Die 110 may be constructed of wood or metal and has a T-shaped projection 112 mounted thereon, such as by suitable adhesive. Projection 112 is preferably made of steel and fits within T-shaped groove 104 on platen 100. Thus, platen 100 functions as a connecting link between hydraulic cylinder 50 and die 110. Die 110 includes a sharp cutting edge 116 extending vertically downwardly from bottom surface 118. This sharp cutting edge is in the form of a symbol or letter to be cut. Pins 120 and 121 also extend from bottom surface 118, a distance that is approximately equal to the distance that the sharp cutting edge extends. These pins function as a marking means to assist the operator (as described below) in aligning the sheet material when respective symbols or letters are cut. Elastomeric material 122 may also extend from bottom surface 118 to protect sharp cutting edge 116 and pins 120 and 121 and to cushion the impact when letters or symbols are cut. Details of steel die 110 are best seen in FIGS. 2 and 3.

Figure 4:
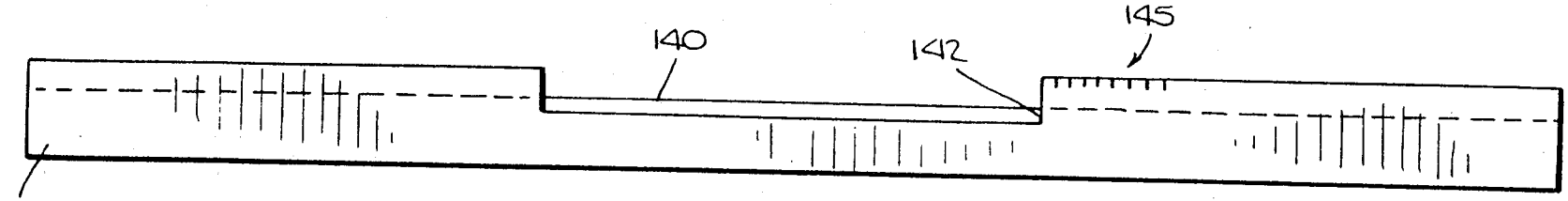
FIG. 4 is a front view of a base member made in accordance with the present invention.
Figure 4A:
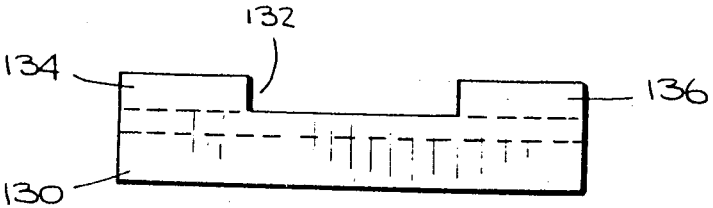
FIG. 4A is a side view of the base member shown in FIG. 4.

A base member 130, preferable constructed of a lightweight metal such as aluminum, is mounted on lower horizontally extending member 22 by any suitable means such as bolts or adhesive (not shown). This base member acts as a cutting surface and includes a track means 132 formed by projections 134 and 136. This can best be seen in FIGS. 4 and 4A. One or both of projections 134 and 136 may be formed of separate pieces so that the width of track means 132 may be varied to accommodate different size sheet materials.

Indicia 145 are placed on the front surface of base member 130. This indicia may be put on by any suitable means, such as by scribing marks on the aluminum surface. In operation, the operator utilizes holes in sheet material S and indicia 145 to line up the sheet material before a letter or symbol is to be cut. Specifically, if the operator utilizes the hole made by pin 120 in the succeeding cutting operation, by aligning it with one mark of the indicia 145, he will obtain the spacing between letters or symbols that he desires.

In the preferred embodiment of the present invention, a pad 140 is inserted into a groove 142. Pad 140 is made of a suitable material such as polyethylene to help absorb impact when die 110 comes into contact with base member 130. Pad 140 also functions to prolong the life of sharp cutting edge 116.

Sheet material S is shown in roll form 150, 152 and 154. While three rolls have been shown, it should be understood that the apparatus will function with a single roll and may be designed for more than three rolls. Mounting brackets 156, 158 and 160 are provided on left vertically extending member 26 to support sheet material S. As shown, each bracket includes a spindle 162, 164 and 166 for supporting a core 168, 170 and 172 upon which sheet material S is provided.

Figure 5:
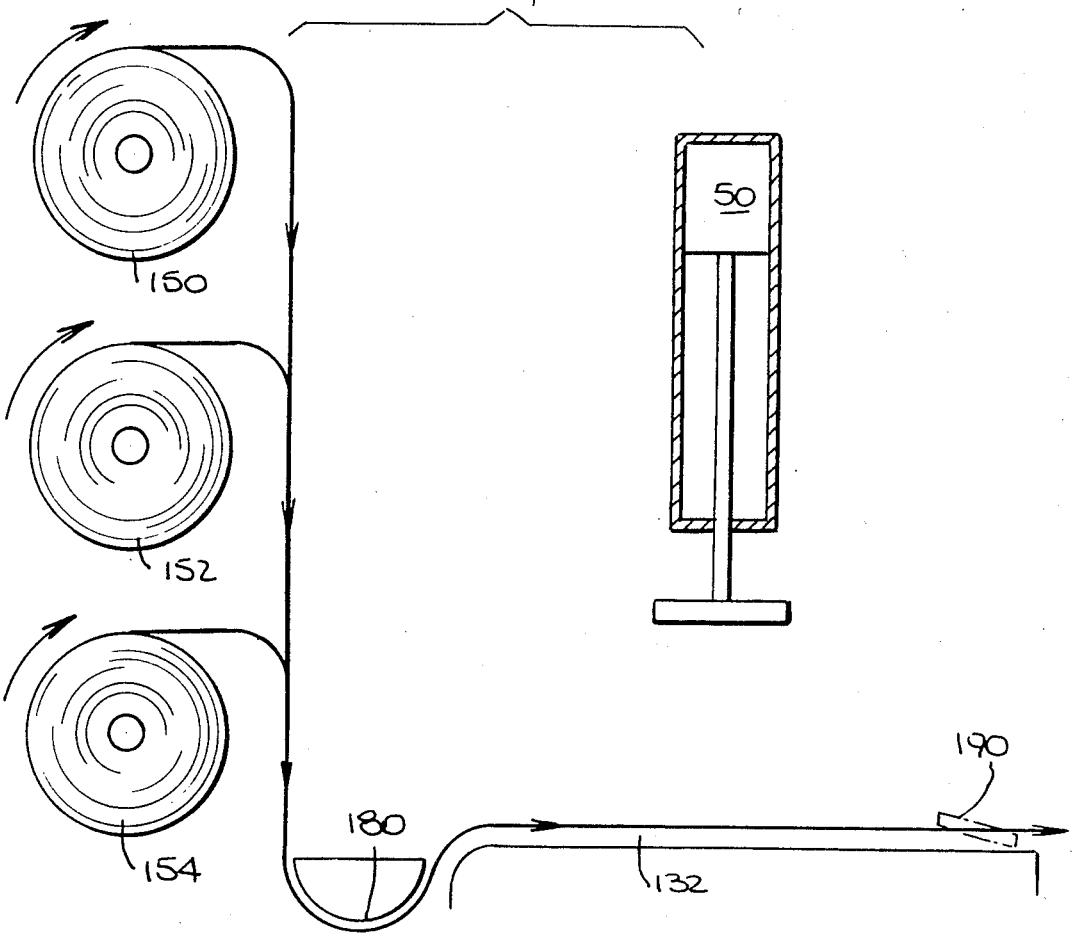
FIG. 5 is a schematic diagram illustrating the flow of sheet material in accordance with the present invention.

As best shown in the diagram of FIG. 5, sheet material S passes vertically downwardly and around a guide surface 180 provided on frame 20. Sheet material S then passes onto track means 132 so that the operator may pull sheet material S through slot 190 (also seen in cutaway in FIG. 1).

Figure 6:
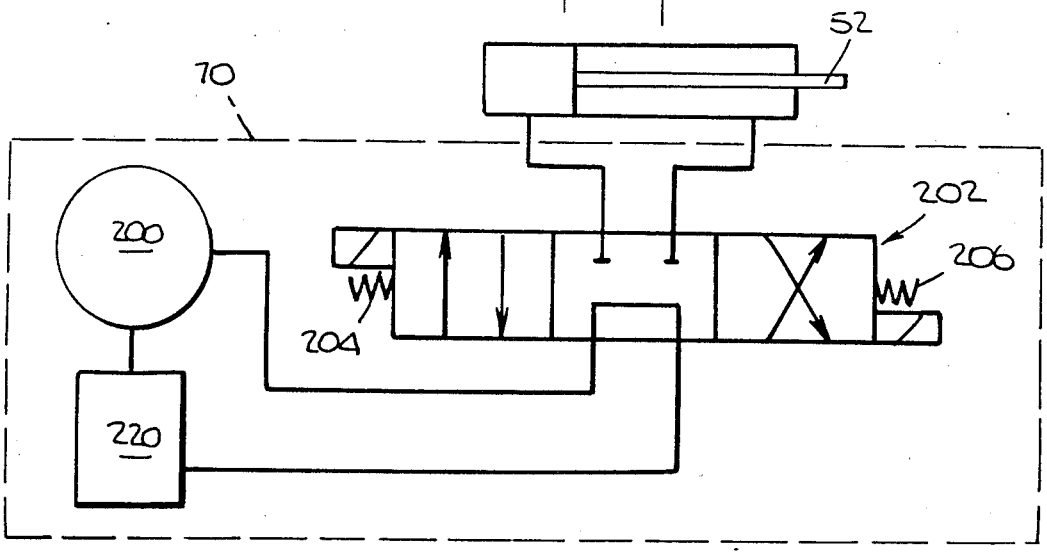
FIG. 6 is a schematic drawing showing the hydraulic circuit of the sign making machine shown in FIG. 1.

Referring to FIG. 6, there is shown a hydraulic diagram of the preferred embodiment of the present invention. A pump 200 is operated by an electric motor as described below. Pump 200 is connected to a three-way directional control valve 202. In the position shown, valve 202 is in the neutral position and fluid returns to reservoir 220 and then pump 200. Those skilled in the art will recognize that a valve spool (not shown) within the valve will either cause fluid to flow in the first position wherein piston rod 52 is extended or a second position wherein it is retracted. Coil springs 204 and 206 keep the spool in a neutral position when not in operation. Pump 200, directional control valve 202 and reservoir 220 are commercially available as a package from Oildyne Inc. as their 330 series power unit. This is referred to as single direction power unit 70 hereinabove. Any suitable hydraulic cylinder may be used with the present invention, however, a Provenair cylinder is preferred.

Figure 7:
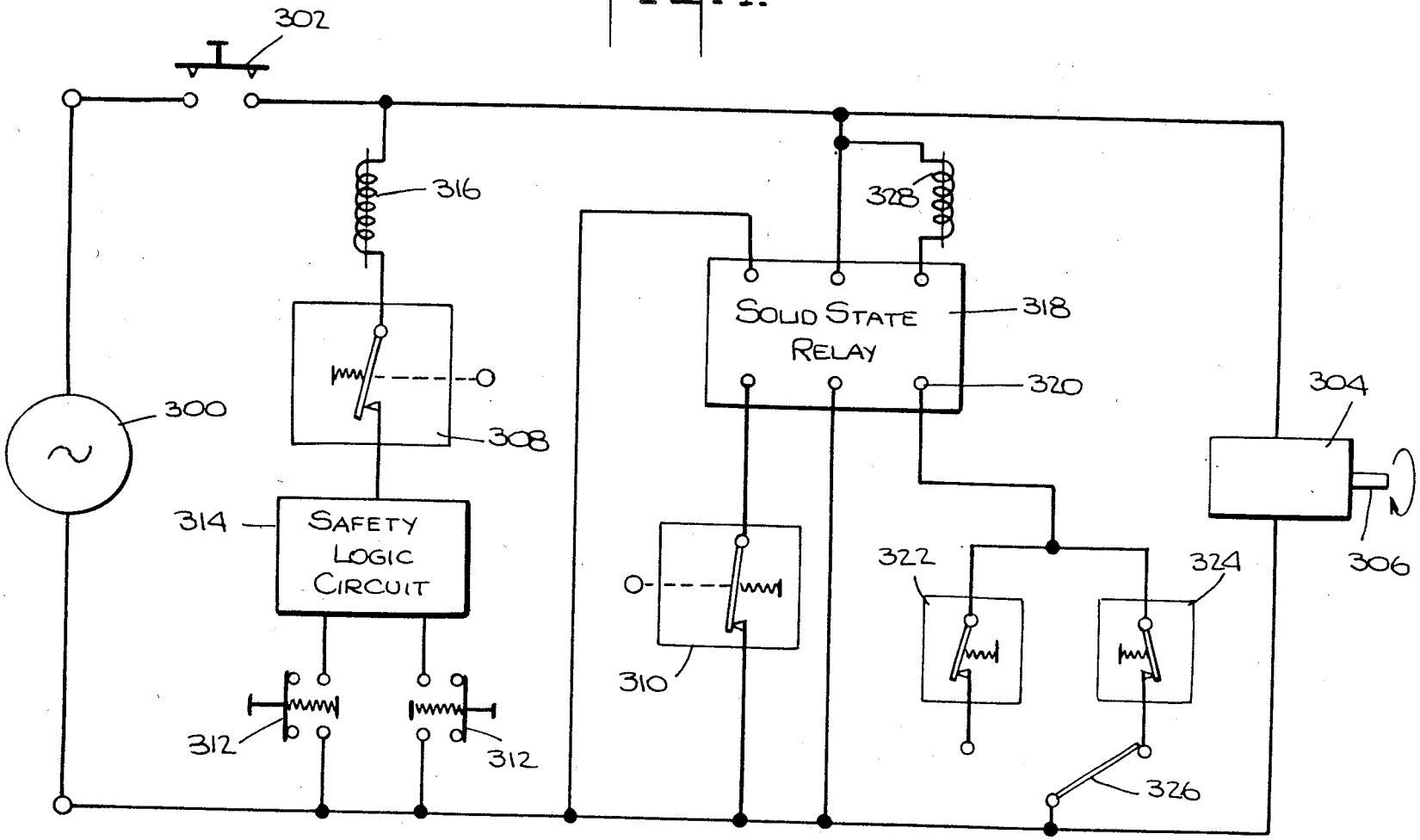
FIG. 7 is a schematic drawing showing the electric circuit of the sign making machine shown in FIG. 1.
Figure 5:
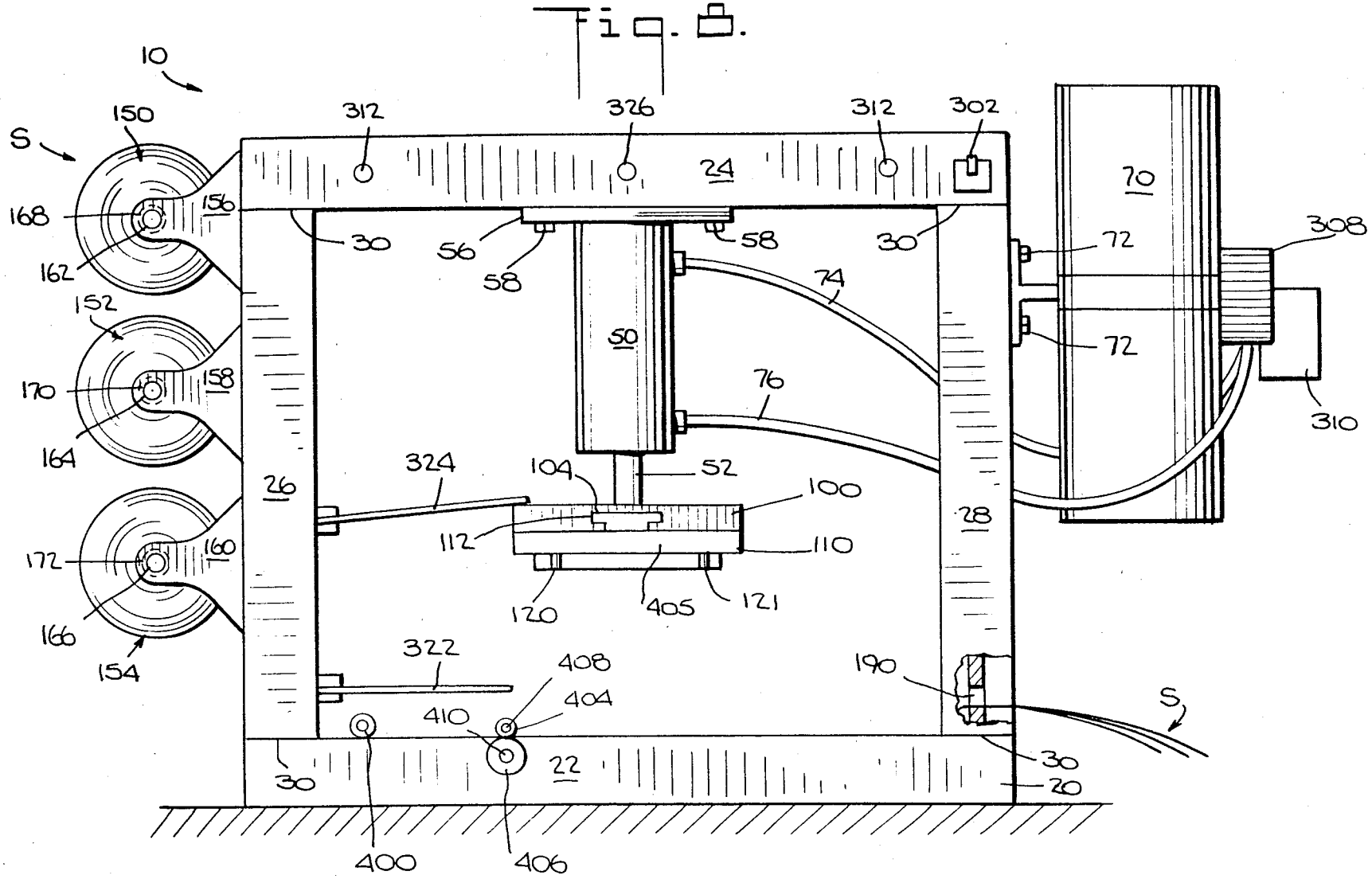

FIG. 7 shows a circuit diagram of the preferred embodiment of the control circuit utilized with the sign making machine of the present invention. The circuit is connected to a source of alternating current power 300. An on-off switch 302 controls the application of A.C. power to the circuit. When the switch 302 is closed by the operator, power is immediately supplied to the circuit and electric motor 304 begins to rotate. The output shaft 306 of motor 304 is mechanically connected to the hydraulic pump 200 which, in turn supplies hydraulic fluid to the hydraulic circuit. On start-up the piston rod 52 is in its retracted position and the directional control valve 202 is in its neutral position. The circuit includes two switches 308 and 310 respectively which are responsive to the pressure in the hydraulic circuit. Switch 308 is of a type in which the switch contacts are closed when the pressure in the hydraulic circuit is less than a pre-determined amount. Conversely, switch 310 is of a type that is closed when the pressure in the hydraulic circuit is more than a pre-determined amount. Thus, in the quiescent state of this circuit switch 308 is closed and switch 310 is open. The switches 308 and 310 are commercially available from the Barksdale Company under Model Number E1H-H500.

In order to activate piston rod 52 a safety feature of this circuit requires the operator to simultaneously close and hold in the closed position a pair of switches 312. The switches 312 are in turn connected to a safety logic circuit 314 which is preferably of the type manufactured by the Struesdell Company under Model No. 84255. If the operator fails to depress both switches at virtually the same time, or fails to hold both switches 312 in the closed position for the duration of the cutting operation, then the safety logic circuit 314 will open thus terminating the extension of piston rod 52 as will become apparent from the ensuing discussion.

The safety logic circuit is connected to the switch 308 which is in the closed position and is in turn connected to solenoid 316. The solenoid coil 316 is part of the actuating solenoid which forces the directional control valve spool into its activating position which in turn causes piston rod 52 to extend. The platen drive cylinder continues to extend until it reaches its limit of travel at which point the pressure in the hydraulic circuit is sufficient to open switch 308 and thus de-energize solenoid 316.

The pressure actuated switch 310 is now closed sending a retract signal to a solid state relay circuit 318. The relay circuit 318 is of a type manufactured by the Gems Company under Model No. ST20198 and serves to hold the signal provided from switch 310 until it is erased by a signal at terminal 320. Terminal 320 is in turn connected to a pair of limit switches 322 and 324. A selector switch 326 is alternately connected to either limit switch 322 or limit switch 324, depending on desired length of the retraction stroke.

With the switch 310 closed the relay 318 provides an energizing signal to retracting solenoid 328 thus causing the spool in the directional control valve to be biased to its retracting position which in turn causes the platen drive cylinder to retract. When piston rod 52 reaches its desired limit of retraction, either limit switch 322 or limit switch 324 will deliver a signal to terminal 320 to end the retraction stroke. Thus the circuit will be returned to its quiescent state with the control spool of the directional control valve being returned to its neutral position to await the start of another cycle. The limit switch arrangement is manufactured by the Allen-Bradley Company under Model No.802T-A and having Model No. 802T-W3A actuator.

Operation of the sign making machine of the present invention is relatively easy. First, the operator checks to see that the desired rolls of sheet material S are on brackets 156, 158 and 160. If not, he loads the desired sheet material S. He may use from one to three rolls in the apparatus shown. Any suitable sheet material may be used, but Scotchlite® reflective sheet material is one that is particularly useful for street signs.

Once the machine is loaded, the operator may flip switch 302 to turn the machine on. He may also check selector switch 326 to make sure that it is set at the preferred retraction stroke. It has been found that retraction strokes of 1 inch and 4 inches are very convenient, but limit switches 322 and 324 could be positioned for other retraction strokes. Once the selector switch is in the desired position, the operator may push both safety switches 312 to cut the letter or symbol in the sheet material S. After the cut has been made, the operator can advance sheet material S until the hole made by pin 120 lines up with the desired spacing mark on indicia 145. This may be repeated until the desired number of symbols or letters are made. Pin 120 is shown as being spaced from letter "T". This would represent the minimum spacing for this letter. It may be desirable to place pin in die 110 so there is no spacing. Then the total letter spacing could be read from indicia 145. Pin 121 marks the front side of letter "T" in case this is necessary.

Figure 9:
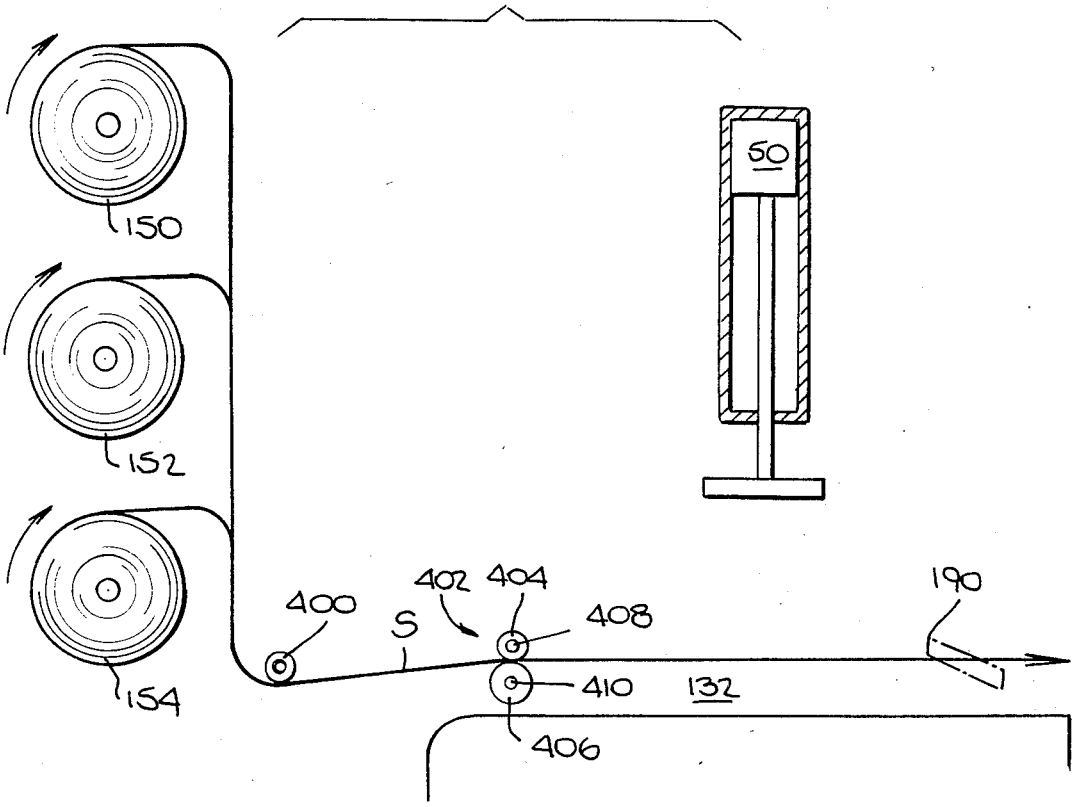
FIG. 9 is a schematic diagram illustrating the flow of sheet material in accordance with the modification of FIG. 8.

Referring to FIGS. 8 and 9, there is shown a modified sign making machine 10' in accordance with the present invention. Sign making machine 10' is in many ways identical to sign making machine 10 and like components have received like reference numerals. The differences between sign making machine 10' and sign making machine 10 lie mainly in the way sheet material S is advanced. Referring to FIGS. 8 through 12, the modified sign making machine 10' will be clearly understood. In this embodiment sheet material S passes beneath and around guide roller 400 and between rollers 404 and 406 of sheet drive unit 402.

In accordance with the present invention modification, each die 110 has indicia, as at 405, on its front surface indicating the width quotient of the symbol to be cut from this die. As used in this application, the term "width quotient" shall mean an indication of the width of the symbol to be cut. It may be the width of the symbol, or for reasons that will be fully understood, it will most likely be one-half the width of the symbol.

Figure 10:
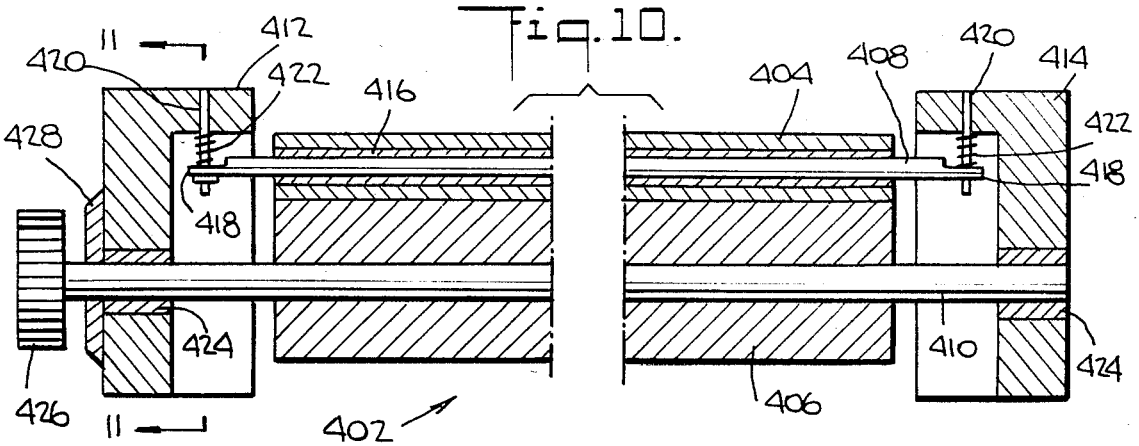
FIG. 10 is a side cross-sectional view of a sheet drive unit used in the modification of FIG. 8.
Figure 12:
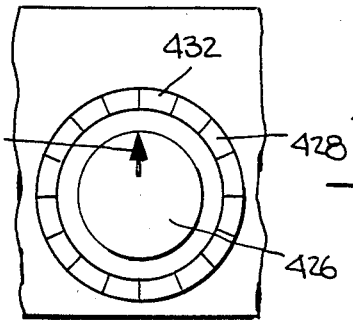
FIG. 12 is a front view of the sheet drive unit of FIG. 10.
Figure 11:
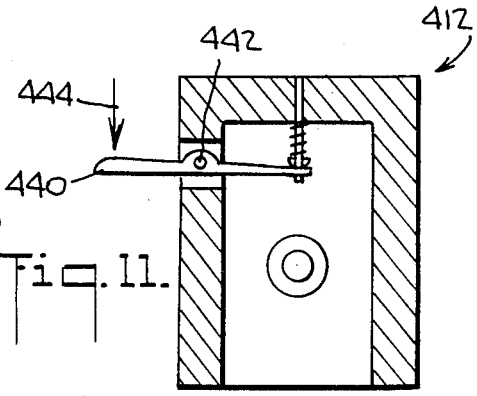
FIG. 11 is a cross-sectional view taken along lines 11—11 of FIG. 10.

Details of the sheet drive unit 402 can best be seen in FIGS. 10, 11 and 12. Referring to FIG. 10, there is shown a cross-sectional side view of unit 402 taken through the longitudinal axes of roller shafts 408 and 410. Rollers 404 and 406 are mounted on shafts 408 and 410 respectively, which are supported on front member 412 and back member 414. Upper roller 404 is mounted on bushing 416 so that it may rotate freely on shaft 408. The ends of shaft 408 each have flattened portions 418. Shaft 408 also has a small hole at each end at each flattened portion to receive pin 420. The top of each of the pins 420 is mounted in a hole in the front member 412 and the back member 414. A coil spring shown diagrammatically at 422 pushes down on each end of shaft 408 to bias upper roller 404 against lower roller 406. Shaft 410 is mounted in a bushing 424 in each of front member 412 and back member 414 so that the shaft 410 and roller 406 may rotate in these members.

Mounted on the front end of shaft 410 is a knob 426 adjacent to dial 428. Rotation of knob 426 rotates roller 406 and advances sheet material S that is between rollers 404 and 406. If desired, the surface of roller 406 may be roughened or textured to better grip sheet material s.

Referring to FIG. 11, there is shown a cross-sectional view of front member 412 taken along lines 11—11. As can be seen, cam 440 is mounted on pin 442 is such a way so that when a force is applied as at 444 to the end of cam 440, the front end of shaft 408 is lifted, allowing one to initially load sheet material S through the sheet drive unit.

Referring to FIG. 12, there is shown a front view of front member 412. As can be seen by this figure, sheet material S can be advanced by comparing the arrow 430 on knob 426 with the indicating means 432 on dial 428. In operation, one can read the width quotient on the front of the die 110 in sign making machine 10' and add it to the width quotient of the next symbol to be cut together with the desired space between the two symbols. For example, if one wanted to cut the letters "W E" and dial 428 was calibrated so that each mark represented one width quotient, one would cut the "W"; add the width quotients of the W and the E, and the space between letters which may be 3, 2, and 1, totalling 6; rotate knob 426, 6 marks on indicating means 432; remove the die for the W; insert the die for the E; and cut E. Thus, with a relatively simple calculation two symbols can be cut with proper spacing there between. This procedure can be repeated for longer words or various symbols, as needed.

Where the particular materials of rollers 404 and 406 are not critical, roller 404 is preferably made of a light metal such as aluminum, and roller 406 is preferable made of steel. Bushings 424 may be made of bronze or other suitable material. Coil springs 422 are selected so that a pressure of approximately 10 to 20 psi is applied to sheet material S. It has also been found that it is convenient to fix the diameter of roller 406 so that one revolution of knob 426 advances sheet material S about 2 inches.

It will be apparent to those skilled in the art that while the die has been shown as being attached to the platen, it may be feasible to place the die on the frame, wherein the platen would funcion as the cutting surface and the sheet material would then pass over the die. Also, while terms such as "beneath" have been used herein to describe the relationship of one part to another, these terms are intended to describe relative positions of various parts and are not to be limited to a vertical plane.

Although the present invention has been described and illustrated above in detail, it is to be clearly understood that the same is by way of illustration and example only and is not to be taken by way of limitation. The spirit and scope of this invention are to be limited only by the terms of the appended claims.

What is claimed is:

1. A sign making machine comprising:

a frame;

a power unit attached to said frame;

a hydraulic cylinder attached to said frame and hydraulically connected to said power unit, said hydraulic cylinder having a piston rod extending downwardly;

a platen mounted on the bottom of said piston rod;

a plurality of dies, each for a unique symbol;

means for mounting one of said plurality of dies on said platen;

means for holding sheet material from which selected symbols are to be made by said sign making machine;

a cutting surface mounted on a bottom portion of said frame beneath said platen, said cutting surface including a track means extending from one portion of said frame adjacent said means for holding sheet material to another portion of said frame where said selected symbols exit from said sign making machine;

each of said dies including a sharp cutting means extending downwardly therefrom, said sharp cutting means being formed in the shape of one of said selected symbols, each of said dies also including a unique indicia means for indicating a unique width quotient of a respective symbol; and means on said frame including indicia correlating to the width quotient indicia for advancing said sheet material in said track by a distance equal to said unique width quotient of said selected symbol plus the unique width quotient of the next selected symbol to be made plus the spacing between selected symbols, whereby actuation of said piston rod forces said die into said sheet material and against said cutting surface to form said one of said selected symbols.

2. A sign making machine as recited in claim 1, wherein said track means is formed by a roller guide and a sheet drive unit, said sheet drive unit comprising a pair of roller means, and a knob on said sheet drive unit forming said means for advancing said sheet material.

3. A sign making machine as recited in claim 2, wherein said cutting surface includes a polyethylene pad for cushioning the impact when said die strikes said sheet material.

4. A sign making machine as recited in claim 3, wherein said means for holding said sheet material does so in roll form.

5. A sign making machine as recited in claim 4, wherein said roll form includes a plurality of rolls.

6. A sign making machine as recited in claim 5, wherein sheet material from each of said rolls is fed through said track means at one time, whereby several pre-selected symbols are made at one time.

7. A sign making machine as recited in claim 4, wherein a resilient material extends downwardly from said die, a distance that is substantially equal to the distance that the sharp cutting edge extends downwardly.

8. A sign making machine as recited in claim 3, wherein a resilient material extends downwardly from said die, a distance that is substantially equal to the distance that the sharp cutting edge extends downwardly.

9. A sign making machine as recited in claim 2, wherein one of said pair of rollers is spring biased and the other of said pair of rollers is linked to said knob.

10. A sign making machine as recited in claim 2, wherein said indicia includes a first indicia on said knob and a second indicia on said frame.

11. A sign making machine as recited in claim 1, wherein said width quotient is ½ the width of said selected symbol.

* * * * *